US005685465A

United States Patent [19]

Berardis

[11] Patent Number: 5,685,465

[45] Date of Patent: Nov. 11, 1997

[54] DEVICE FOR SHAPING THE BRIM OF A BASEBALL CAP

[76] Inventor: Luke J. Berardis, R.D. 1 Box A132, Harpursville, N.Y. 13787

[21] Appl. No.: 643,658

[22] Filed: May 6, 1996

[51] Int. Cl.[6] ..... A47G 25/10

[52] U.S. Cl. ..... 223/84; 223/24; 211/30

[58] Field of Search ..... 223/1, 84, 24, 223/25, 26, 85; 206/303, 449, 335; 211/30, 31, 32, 33

[56] References Cited

U.S. PATENT DOCUMENTS

| | | | |
|---|---|---|---|
| 484,085 | 10/1892 | Caspar | 211/32 |
| 1,449,698 | 3/1923 | Roragen et al. | 311/32 |
| 1,608,785 | 11/1926 | Alexander | 211/30 |
| 3,858,769 | 1/1975 | Billingslea | 223/84 |
| 5,038,941 | 8/1991 | Bastiaansen | 211/32 |
| 5,137,157 | 8/1992 | Lawson | 211/32 |
| 5,188,325 | 2/1993 | Hilty et al. | 248/224.4 |
| 5,344,003 | 9/1994 | Park | 211/32 |
| 5,396,994 | 3/1995 | Fitzgerald | 211/30 |
| 5,480,073 | 1/1996 | LaManna | 223/1 |

*Primary Examiner*—Bibhu Mohanty
*Attorney, Agent, or Firm*—Salzman & Levy

[57] ABSTRACT

The present invention features a brim-shaping device for a baseball-type cap, a device that helps create and maintain the desired curvature of the cap brim. The shaping device is a mold that has a substantially hollow, curved body, and a curved, shaping slot for insertion of the cap brim into the hollow, curved body. The mold may have a number of slots running along the sides of it to allow for aeration of the cap when it is wet, so that the cap will dry more easily after washing. The hollow mold is shaped to present the cap at a given angle, so that the cap portion is displayed above the brim as it rests in the shaping slot. The given angle, usually approximately thirty degrees, presents a good angle for a viewing display. This angle also allows a washed baseball cap to drain of water. The mold itself is attachable to a display rack, so that the shaping device can also double as a merchandising tool during the sale of the cap. That is, both the cap and the shaping tool can be sold together as a single unit. An alternate embodiment features a detachable rear, stand section that, when removed, allows the mold to act as a clamping device, but when attached to the front, body section, allows the mold to stand alone or be attached to a wall mounting plate.

2 Claims, 4 Drawing Sheets

DEVICE FOR SHAPING THE BRIM OF A BASEBALL CAP

FIELD OF THE INVENTION

The present invention pertains to hat-brim shaping devices and, more particularly, to a hat-brim patterning apparatus for molding the shape of baseball-cap brims.

BACKGROUND OF THE INVENTION

Baseball players take pride in their equipment. It is not uncommon to see fielders spend hours oiling and shaping their gloves or mitts. Many pieces of baseball equipment become routinely bent out of shape, due to the rigorous activity of the sport. Among the items on the receiving end of rough, physical treatment are the brims of baseball caps, which regularly become bent and misshapen during games and exercises. This is a problem not only for baseball players, but for all others who wear baseball-type caps for sports, work or recreation.

Due to their weak construction, it is difficult to form a desired shape or restore the shape of baseball-cap brims. Once the brims become misshapen, for example, they cannot easily be restored to their original shape.

The present invention is based on the discovery that the brims of baseball caps will maintain their curvature when, during non-usage hours, they are forced into a predetermined curvature over an extended period of time. In other words, the brims of baseball caps are similar to shoes that respond to shoe-tree stretching.

The current invention features a molding device that holds the brim of a baseball cap, forming and maintaining the desired curvature thereof. After rigorous use, baseball-cap brims can be soaked in a mild solution of detergent to clean them. The inventive shaping device allows the brims to dry and, at the same time, reintroduces their desired curvature.

In the field of merchandising, the molding device of this invention has the additional capability of being a display apparatus. Each baseball cap in a display can be held by individual molding devices, some or all of which can also be attached to a display rack. Each of the baseball molds can be attached to the display rack by bayonet pins or detent snaps. The brim of each cap is held by each mold upon the display rack at a visibly attractive display angle of approximately thirty degrees. Shaping molds, with baseball caps, can each be sold as a unit, thus improving their marketability. At the time of purchase, both the mold and the hat can be removed from the rack in one piece. Due to inexpensive production, a purchaser may have the advantage of buying both hat and shaping device for essentially the same price of the hat alone.

It is an object of this invention to provide a brim-shaping device for baseball caps.

It is another object of the invention to provide a brim-shaping tool that can double as a display.

It is still another object of this invention to provide a brim-shaping device that will also serve as a means to hold the cap in a suitable draining position after washing.

DISCUSSION OF RELATED ART

In U.S. Pat. No. 3,858,769 (entitled "Rolled Hat Brim Shaping Device", and issued to BILLINGSLEA, Jr., on Jan. 7, 1975), a wire retaining frame is illustrated for shaping the brim of a cowboy hat. The brim is contained by the frame, which then imparts or maintains a given curvature to the brim. No contact is maintained between the frame and both sides of a hat brim.

The present invention comprises a hollow mold for shaping the brim of a baseball cap, which is differently shaped than a cowboy hat. The shaping device of this invention may have slots in the hollow mold that allow for aeration of a washed cap, thus facilitating the drying of a wet cap after washing. The shaping device of the present invention completely encompasses the brim, displaying the hat at a given angle. The given angle presents the cap at a good display orientation, and can also allow for adequate drainage when the cap is wet.

SUMMARY OF THE INVENTION

In accordance with the present invention, there is provided a brim-shaping device for a baseball cap, a device that imparts or helps maintain the brim's desired curvature. The shaping device comprises a mold having a substantially hollow, curved body, as well as a curved, shaping slot for insertion of the cap brim into the hollow, curved body. The mold may have a number of slots running along the sides of the mold for allowing aeration of the cap when it is wet, so that the cap will dry more easily after washing. The hollow mold is shaped to present the cap at a given angle, so that the cap portion is displayed above the brim as it rests in the shaping slot. The given angle, usually approximately thirty degrees, provides a favorable orientation for a viewing display. This angle also allows a washed baseball cap to drain of water. The mold itself is attachable to a display rack, whereby the shaping device can also double as a merchandising tool during the sale of the cap. Both the cap and the shaping tool can be sold as a single unit.

BRIEF DESCRIPTION OF THE DRAWINGS

A complete understanding of the present invention may be obtained by reference to the accompanying drawings, when considered in conjunction with the subsequent, detailed description, in which.

For purposes of brevity and clarity, like elements and components of this invention will bear the same numerical designation throughout the FIGURES.

DESCRIPTION OF THE PREFERRED EMBODIMENT

Generally speaking, the invention features a shaping mold for receiving and holding the brim of a baseball cap. The shaping mold allows the brim of the baseball cap to dry after washing, and creates and maintains the proper, natural curvature of the brim when not in usage. Of course, the hat need not be washed or even wet when placed in the inventive mold, in order to perform the shaping function. The shaping mold also can be used as a stand for displaying the baseball cap at the time of sale.

Figure 1:
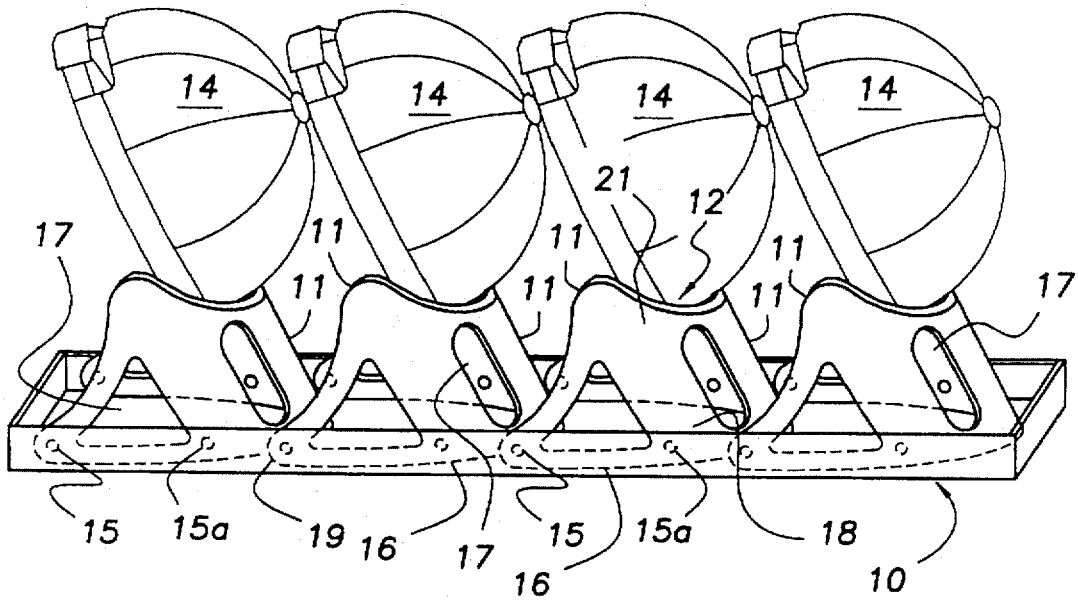
FIG. 1 illustrates an in situ, perspective view of a number of the shaping devices of this invention, disposed upon a display rack with various baseball caps disposed thereon.
Figure 2:
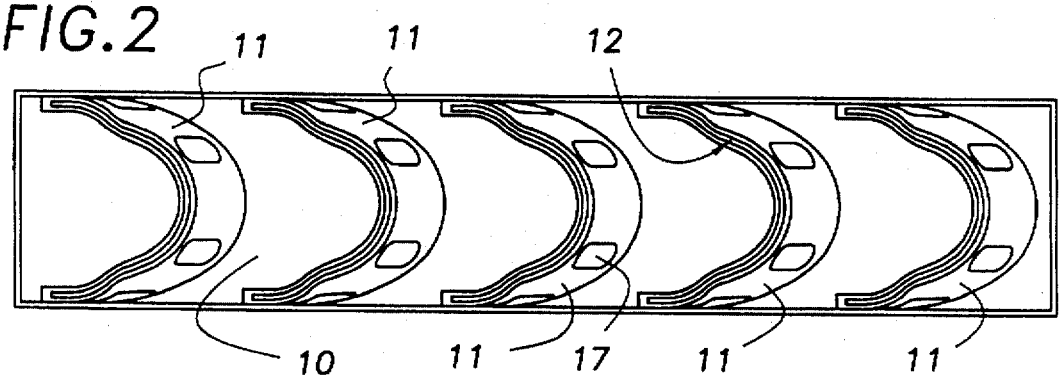
FIG. 2 depicts a top view of the shaping device and display rack shown in FIG. 1.
Figure 5:
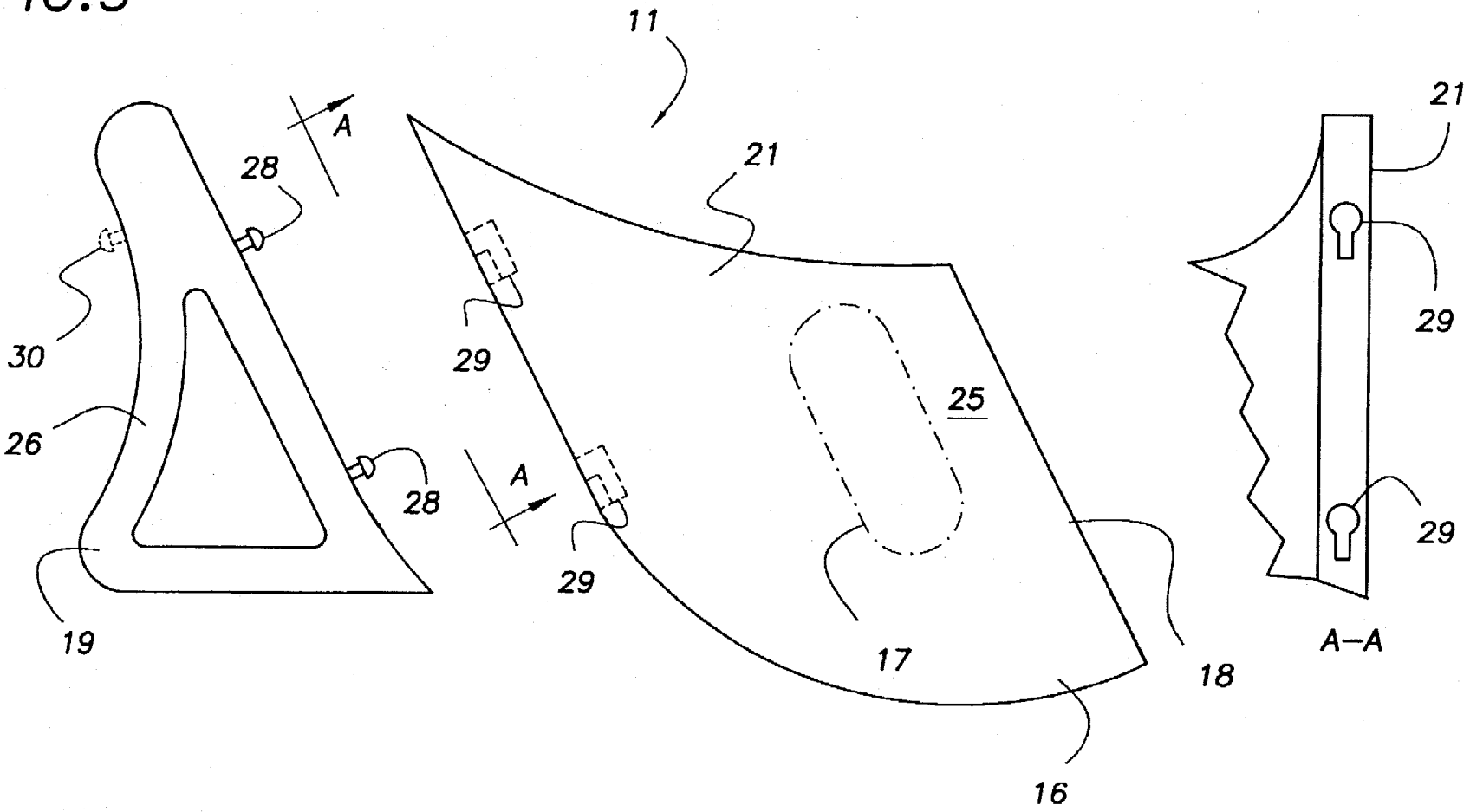
FIG. 5 illustrates an exploded side view of an alternate embodiment shaping device.
Figure 6:
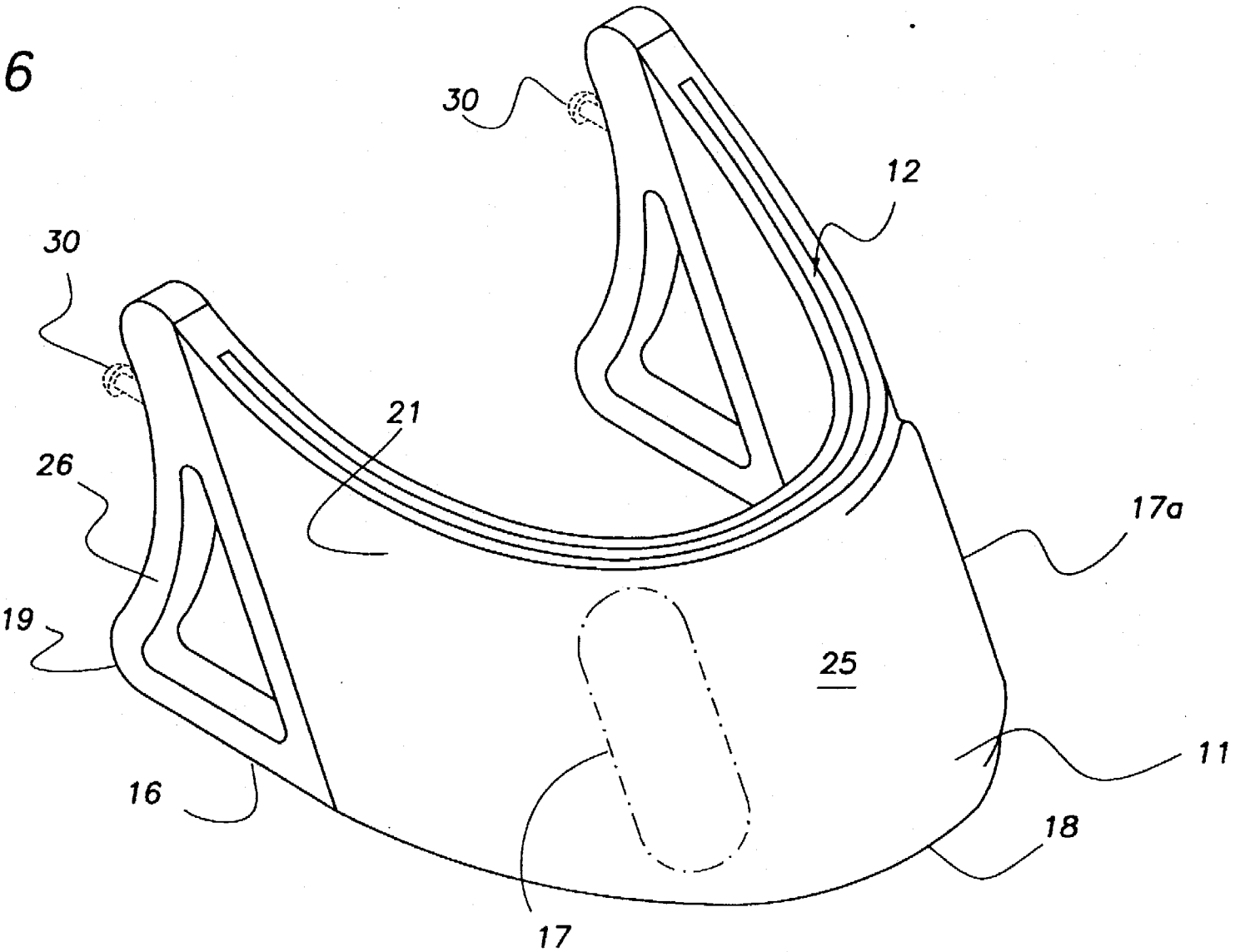
FIG. 6 illustrates an assembled, perspective view of the shaping device depicted in FIG. 5.

Now referring to FIGS. 1 and 2, a display rack base 10 is shown, supporting a plurality of shaping molds 11 of this invention. The shaping mold 11 has a peripheral slot 12 in the upper section 21 that receives the brim of the baseball cap 14; a better view of slot 12 is observable in FIGS. 2, 4 and 6. Each shaping mold 11 is substantially hollow. Each mold 11 is attached to the display rack 10 via a pair of bayonet pins or detent snaps 15, disposed on distal end 19 of the base portion 16 of the shaping mold 11. If so desired, the shaping molds 11 can also rest on the display rack 10 without being snapped into place. In fact, when intended to be standalone devices, the mold 11 need not be provided with pins or snaps 15, as shown in FIGS. 5 and 6. Alternatively, the molds 11 may be adapted to mount directly onto a mounting plate, not shown, as described in greater detail hereinbelow.

The shaping mold 11 holds the baseball cap 14 at a given angle, generally at approximately 30 degrees relative to the flat, base portion 16. This angle has two purposes: as a means to allow a washed cap 14 to drain of water; and to present a good viewing angle for display purposes. For the purpose of aeration, optional side slots 17 may be disposed in the body of the shaping mold 11, allowing the cap 14 to dry quickly after washing. For ease of manufacture, however, providing actual slots 17 may not be advisable. In that case, raised ribs 17*a* can be used to provide an advertising border for decals, hot-stamping or other mechanisms for displaying graphic logos and/or messages on the front 25 (FIG. 4) of mold 11.

Figure 3:
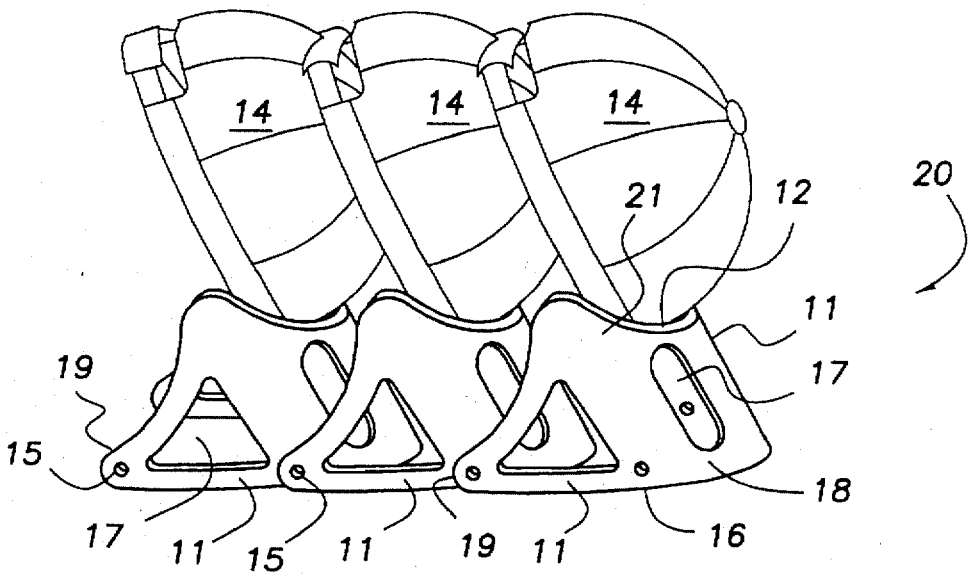
FIG. 3 shows a perspective view of an alternate display embodiment for the shaping device illustrated in FIG. 1.

Referring to FIG. 3, an alternate embodiment 20 is shown for displaying the shaping devices 11 with their respective baseball caps 14. The shaping devices 11 are positioned in tandem, one behind the other, with no need for a display rack 10 (FIG. 1); this is made possible by the detent snaps 15 disposed on each end 19 of the base portion 16. The detent snaps 15 can fit into snap depressions 15*a* (which are better observed in FIG. 1) in the front section 18 of the mold 11.

Figure 4:
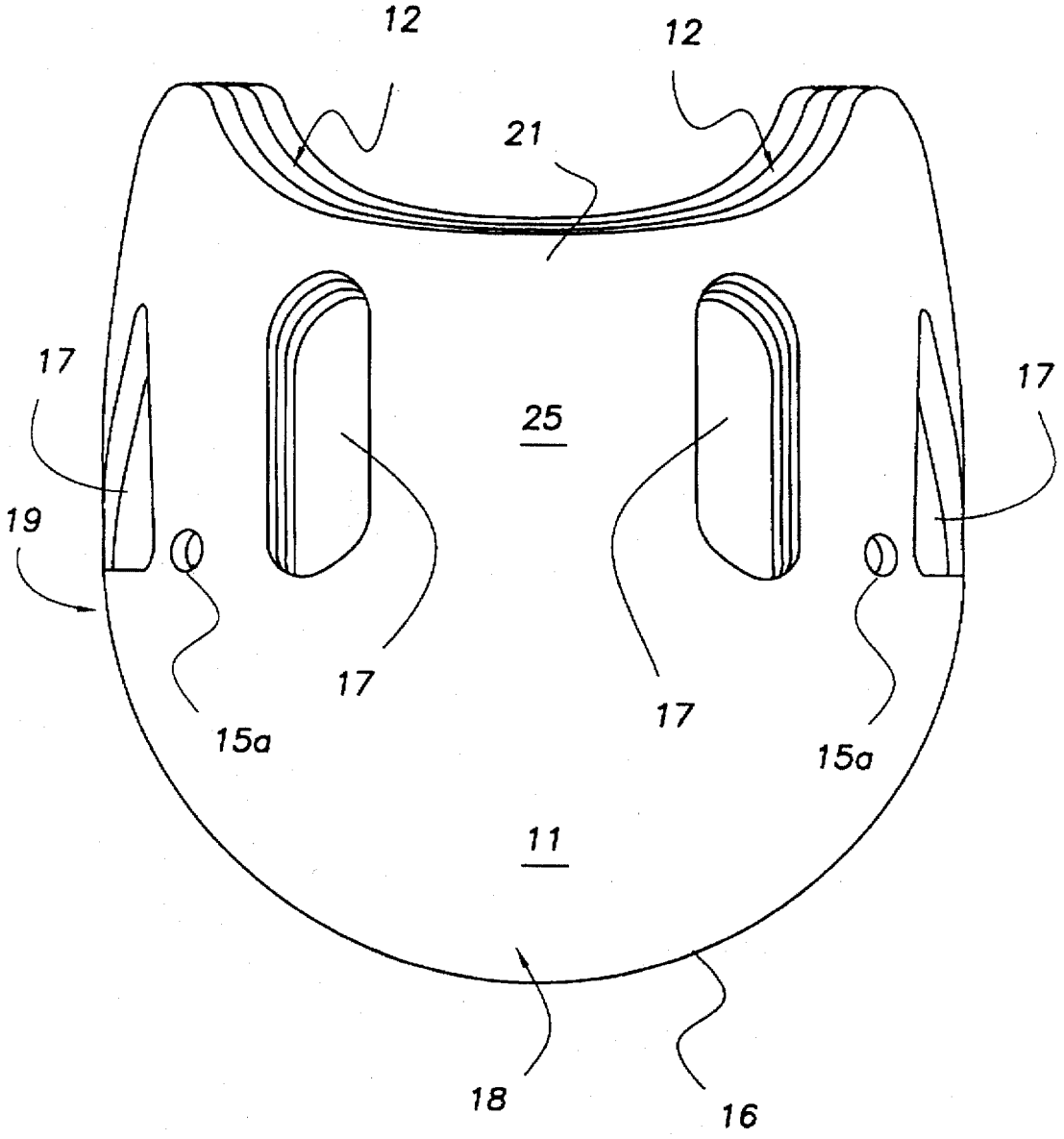
FIG. 4 depicts a front view of the shaping device shown in FIG. 1.

Referring to FIG. 4, the hollow mold 11 is shown in front view. The upper peripheral slot 12 for receiving the brim of the baseball cap 14 (FIGS. 1 and 3) runs through the entire body of the mold 11, thus making the mold substantially hollow and supporting both upper and lower surfaces of the cap 14. The mold 11 stands on its base portion 16. The brim of a baseball cap 14 is inserted into the slot 12 at the top portion 21. Optional aeration slots 17 or raised ribs 17*a* may be provided. When the face or front portion 25 of mold 11 is formed without aeration slots 17, advertising logos, designs or trademarks can be displayed thereon, thus providing yet another marketing feature for the product. The body of the mold 11 can be made of a wide variety of materials (such as styrene, polypropylene, lucite or even urethane foam materials).

Referring now to FIGS. 5 and 6, there are shown exploded and assembled views, respectively, of an alternative embodiment of the present invention. The front 25 and base 16 portions of mold 11 are detachable from rear portion 26. The mold 11 may be sold as a fully stable hat holder and stand, when rear portion 26 is attached to front portion 25; or as a brim-shaping device 11 which can be hung freely from a hat rack, not shown, when rear portion 26 is detached therefrom. Rear portion 26 is provided with two key tabs 28 that can mate with corresponding keyhole slots 29, disposed in front portion 25 of mold 11, and shown in greater detail in the enlarged view, taken along section A—A of FIG. 5.

In another embodiment, optional key tabs 30, one on each side of the rear top portion 26 of mold 11 (FIG. 6), are provided to facilitate mounting of the mold 11 onto a wall mounting plate, not shown, in a manner similar to that shown in FIG. 5, section A—A.

Since other modifications and changes varied to fit particular operating requirements and environments will be apparent to those skilled in the art, the invention is not considered limited to the examples chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A shaping and display device for receiving and shaping brims of standard baseball caps, said shaping and display device comprising a substantially flat base for displaying a plurality of standard baseball caps, each baseball cap being mounted upon a plastic, arcuate body section having respective upper and lower portions connected to each other and forming a hollow, curved internal slot portion having dimensions of a standard baseball cap brim for shaping a standard baseball cap brim therein, each of said body sections disposed at an angle with respect to said substantially flat base for the purpose of allowing said baseball caps to be displayed in a side-by-side manner, each of said plastic, arcuate body sections being successively attached to each other upon said substantially flat base, and further wherein each of said plastic, arcuate body sections comprise elongated, spaced-apart aeration slots intersecting said internal slot portion.

2. A plurality of shaping devices mounted upon a substantially flat base used for displaying a plurality of standard baseball caps, each of said shaping devices for receiving and shaping a brim of each of said standard baseball caps, each of said shaping devices comprising an arcuate body section having both an upper and a lower portion connected to each other and forming a closed, hollow, curved internal slot portion therein for housing and supporting both upper and lower surfaces of said brim of each of said standard baseball caps, each of said body sections being disposed at an angle with respect to said substantially flat base for the purpose of allowing said standard baseball caps to be displayed, said plurality of shaping devices being connectable to each other, and disposed in tandem, one adjacent another, said brims of each of said plurality of standard baseball caps being shaped when disposed in each of said closed, hollow, curved internal slot portions, and further wherein each of said body sections comprise elongated, spaced-apart aeration slots intersecting said internal slot portions.

* * * * *